US005387171A

United States Patent [19]

Casey et al.

[11] Patent Number: 5,387,171

[45] Date of Patent: Feb. 7, 1995

[54] VARIABLE RESISTANCE BAND EXERCISE MACHINE

[75] Inventors: Michael E. Casey, Lakewood; Timothy G. Krivanek, Parma, both of Ohio

[73] Assignee: National Barbell Supply, Inc., Beachwood, Ohio

[21] Appl. No.: 182,289

[22] Filed: Jan. 14, 1994

[51] Int. Cl.[6] ..... A63B 21/04

[52] U.S. Cl. ..... 482/130; 482/138; 482/142; 482/145; 482/133

[58] Field of Search ..... 482/130, 129, 133, 138, 482/142, 145, 100, 137, 121

[56] References Cited

U.S. PATENT DOCUMENTS

| | | | |
|---|---|---|---|
| D. 329,672 | 9/1992 | Shieh . | |
| 4,072,309 | 2/1978 | Wilson | 482/130 |
| 4,627,619 | 12/1986 | Rockwell et al. | 482/137 |
| 4,632,390 | 12/1986 | Richey | 482/142 |
| 4,691,918 | 9/1987 | Rockwell | 482/142 |
| 4,801,139 | 1/1989 | Vanhoutie et al. | 482/138 |
| 4,809,972 | 3/1989 | Rasmussen et al. | 482/138 |
| 4,915,379 | 4/1990 | Sapp | 482/130 |
| 5,011,140 | 4/1991 | Adessi | 482/138 |
| 5,054,773 | 10/1991 | Parviainen | 482/138 |
| 5,088,726 | 2/1992 | Lapcevie . | |
| 5,098,088 | 3/1992 | Cohen et al. . | |
| 5,135,458 | 8/1992 | Huang . | |
| 5,160,305 | 11/1992 | Lin . | |
| 5,178,599 | 1/1993 | Scott . | |
| 5,190,509 | 3/1993 | Davison, Jr. . | |
| 5,195,937 | 3/1993 | Engel et al. . | |
| 5,201,694 | 4/1993 | Zappel . | |
| 5,215,511 | 6/1993 | Cheng | 482/142 |
| 5,236,406 | 8/1993 | Webber . | |
| 5,242,347 | 9/1993 | Keeton . | |
| 5,254,066 | 10/1993 | Brown et al. . | |
| 5,254,067 | 10/1993 | Habing et al. . | |
| 5,256,126 | 10/1993 | Grotstein | 482/121 |

*Primary Examiner*—Stephen R. Crow
*Assistant Examiner*—Lynne A. Reichard
*Attorney, Agent, or Firm*—Howard M. Cohn

[57] ABSTRACT

A variable resistance band exercise machine for exercising the body of a user including their arms, waists and legs. The user moves various groups of movable exercise components against the resistance provided by elastically deformable resistance bands. The deformable resistance bands are removable and can be interchangeably exchanged with any group of exercise components.

3 Claims, 5 Drawing Sheets

VARIABLE RESISTANCE BAND EXERCISE MACHINE

RELATED APPLICATIONS

This application relates to Design patent application Ser. No. 29/014,864, filed Nov. 1, 1993, and entitled VARIABLE RESISTANCE BAND EXERCISE MACHINE, by Michael E. Casey and Timothy G. Krivanek.

FIELD OF THE INVENTION

This invention relates to the field of exercise machines. More particularly, the invention relates to a variable resistance band exercise machine which only requires a single, interchangeable, resistance band, supports the user's back, and enables abdominal exercises.

BACKGROUND OF THE INVENTION

There are many different kinds and styles of fitness equipment available on the market. All of the machine designs have every group of training components secured to a means of creating a resistance during their movement which has to be overcome by the user in order to achieve training results. This resistance is typically created by weights or springs. Even though most of the exercise equipment on the market is multi-functional, each separate group of training components requires attachment to the means of generating the resistance. For example, with the type of exercise machine that trains arms, waists, and legs, there are three separate training components, each having its own means of generating resistance, such as three distinct groupings of independent weights or springs. However, since each exercise component member is operated independently, the weight or springs that are connected with the components that are not in use are redundant, and make the design deficient because it is needlessly complex and expensive to manufacture.

OBJECTS AND SUMMARY OF THE INVENTION

It is an object of the present invention to provide a variable resistance band exercise machine that can be used for different exercise to obviate the problems and limitations of the prior art systems.

It is a further object of the present invention to provide a variable resistance band exercise machine where the user's back is supported.

Yet another object is to provide an improved variable resistance band exercise machine which is able to use only a single interchangeable band for generating resistance for a number of different exercise components.

In accordance with the invention, there is provided a variable resistance band exercise machine for exercising the body of a user including their arms, waists and legs. The user moves various groups of training components against the resistance provided by elastically deformable, resistance bands or belts. The elastically deformable resistance bands are removably secured at various locations, depending upon the specific use and position of the training component. Each band is elastic and preferably made of rubber or an elastomer which produces a resistance as it is stretched by the movement of a particular training component. The increased resistance enables the user to effectively exercise various muscle groups. Although the bands are mounted between stationary holes and spaced adjustment holes, they are the same length for each group of training components.

According to the invention, training components which are not in use during a particular exercise routine do not need to remain attached to their associated resistance band and thereby avoid the need for extra bands or other means of generating resistance, such as for example, weights or springs, against the movement of each training component.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 1:
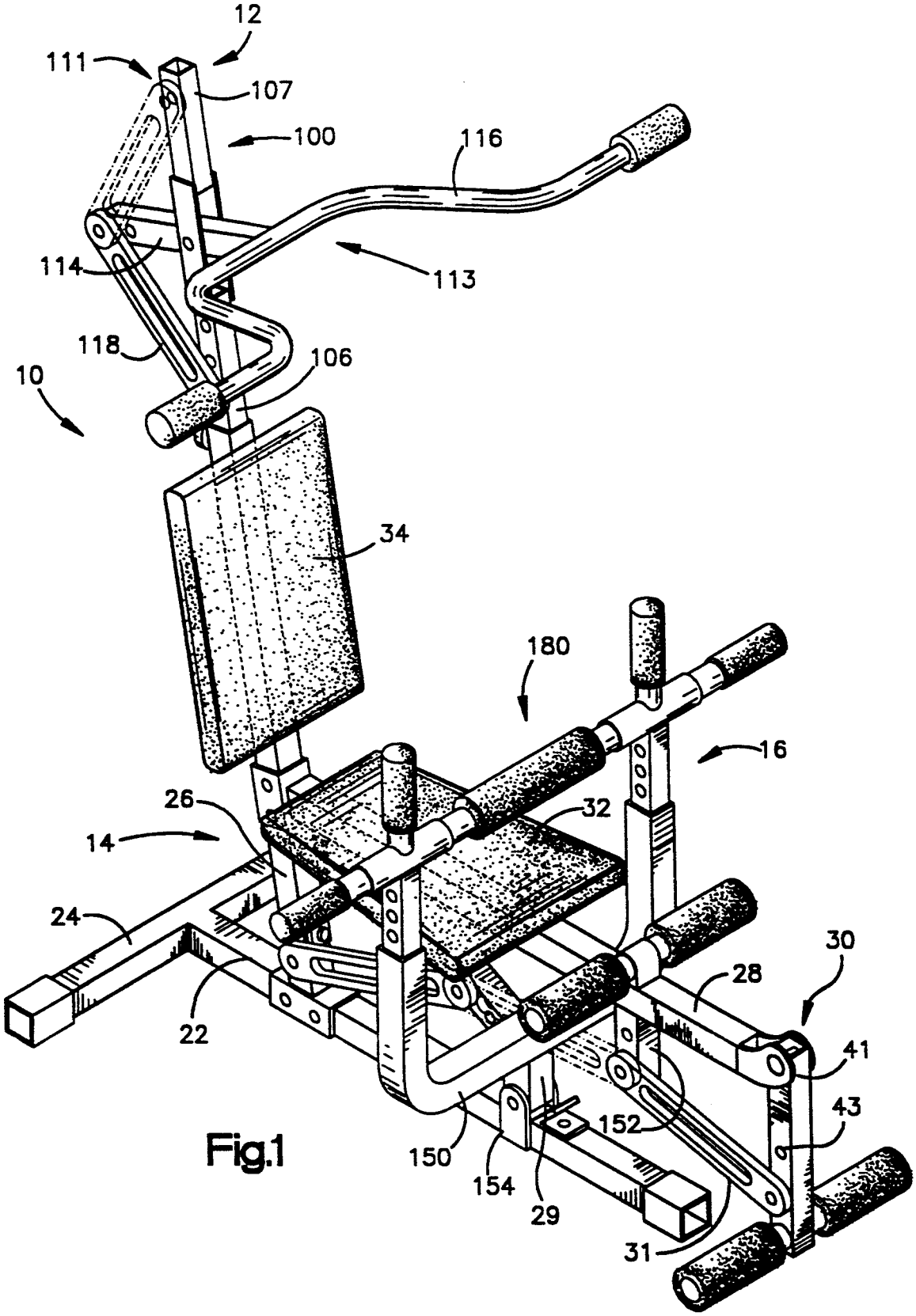
FIG. 1 is a perspective view of a variable resistance band exercise machine in accordance with the invention.
Figure 2:
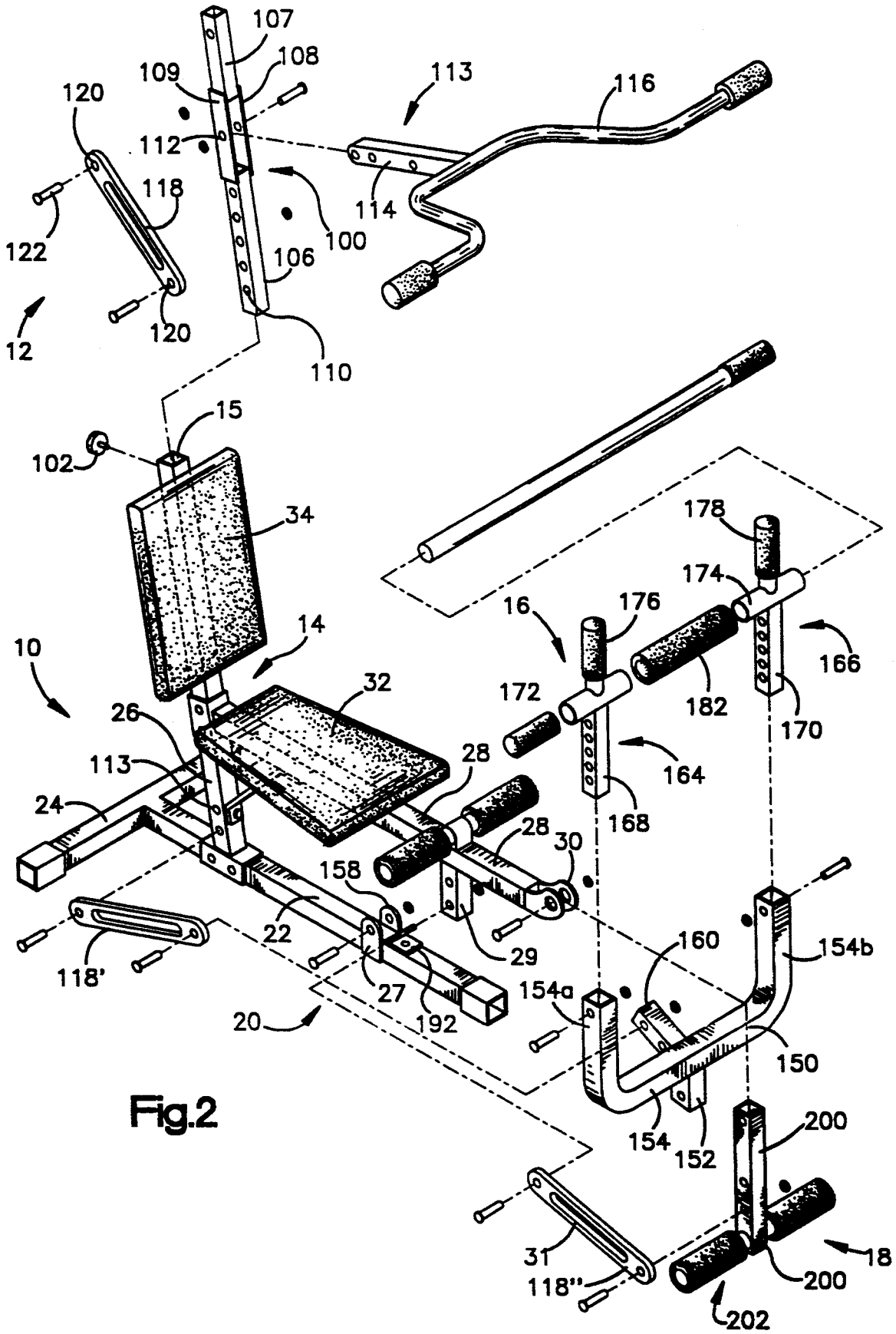
FIG. 2 is an exploded view of the variable resistance band exercise machine shown in FIG. 1.

Referring to FIGS. 1 and 2, there is illustrated a variable resistance band exercise machine 10 which incorporates a three or more groupings of training components for exercising different parts of a users body. There is one group of arm training components 12 located above the upper end of a support assembly 14. A second group of waist training components 16 are generally located toward the forward end of the support assembly 14. A third group of leg training components 18 are mounted at the forward end of support assembly 14.

The support assembly 14 is generally constructed from rectangular or square tubular members and includes a T-shaped base member 20 having an elongated base section 22 with a transverse base section 24 secured to a rear end thereof. Base member 20 provides a solid support to keep the machine 10 in an upright position and ensure that it is stable and does not move or wobble in use. An upright support frame member 26 is securely mounted by any desired means, such as bolting or welding, to the base section 22 of base member 20. Upright, spaced support plates 27 are attached to opposite sides of base section 22 and project upward therefrom. Diametrically opposed mounting holes are provided thereon for mounting the waist training components, as discussed below. A V-shaped stop 29 is secured to the upper surface of base section 22 to limit the forward movement of the waist training components. A forward extending, seat support frame member 28 is secured at one end to upright support frame member 26 at a location above base member 20 and is cantilevered outward therefrom towards the forward end of machine 10. Spaced mounting plates 30 with mounting holes therethrough are provided at the forward end of frame member 28. A resistance band attachment member 31 is secured the underside of frame member 28 and includes several connection holes therethrough. A seat 32 is securely mounted to seat support frame member 28, intermediate the ends thereof.

A principle feature of this invention is the provision of a back support 34 which is securely mounted to upright back support frame member 26. As discussed in detail below, back support 34 supports the back of a user during many exercises and tends to prevent injuries which often occur as a result of the user straining his or her back when it is unsupported.

Referring now to the arm training components 12, an adjustable, vertical support member 100 is telescopically mounted within upright back support frame member 26 and secured in place with a screw 102 protruding from a manually operated knob for tightening into a threaded hole (not shown) in frame member 26. Support member 100 includes spaced upper and lower support tubular members 106 and 107 interconnected by spaced plates 108 and 109. Several spaced adjustment holes 110 and 111 are provided in lower and upper support square tubular members 106 and 107, respectively, to provide for the adjustment of a resistance band 118, as discussed below. Opposing mounting holes 112 are provided through plates 108 and 109 for pivotal attachment to a handle component 113. The handle component 113 has an arm 114 with a horn-like handle 116 secured to one end and several adjustment holes for connection to resistance band 118 at the other end.

A principle feature of this invention relates to a resistance band 118 having connection holes 120 at either end and formed of an elastic material, such as rubber or an elastomer. Typically, the bands 118 are made of a rubber material which has a high degree of elasticity. The bands preferably have a cutaway middle section to form a continuous band with the wall thickness controlling the amount of elastic force generated by the stretching of the band. Thus, bands of the same overall shape and thickness but with a different band wall thickness can provide a different resistance. Attachment holes are provided on opposite ends of the band 118. Irrespective of the band wall thickness, the distance between the two mounting holes is substantially the same for each band.

As seen in FIGS. 1 and 2, with the arm 114 pivotally mounted to support bar 100, the rear end of arm 114 is secured to one end of band 118 by a removable locking pin 122 through hole 120 of resistance band 118 and an adjustment hole at the end of arm 114. The hole 120 at the other end of resistance band 118 can be connected by a locking pin to either adjustment hole 110 in member 106 or an adjustment hole 111 in member 107, depending on the particular exercise to be performed.

Figure 3:
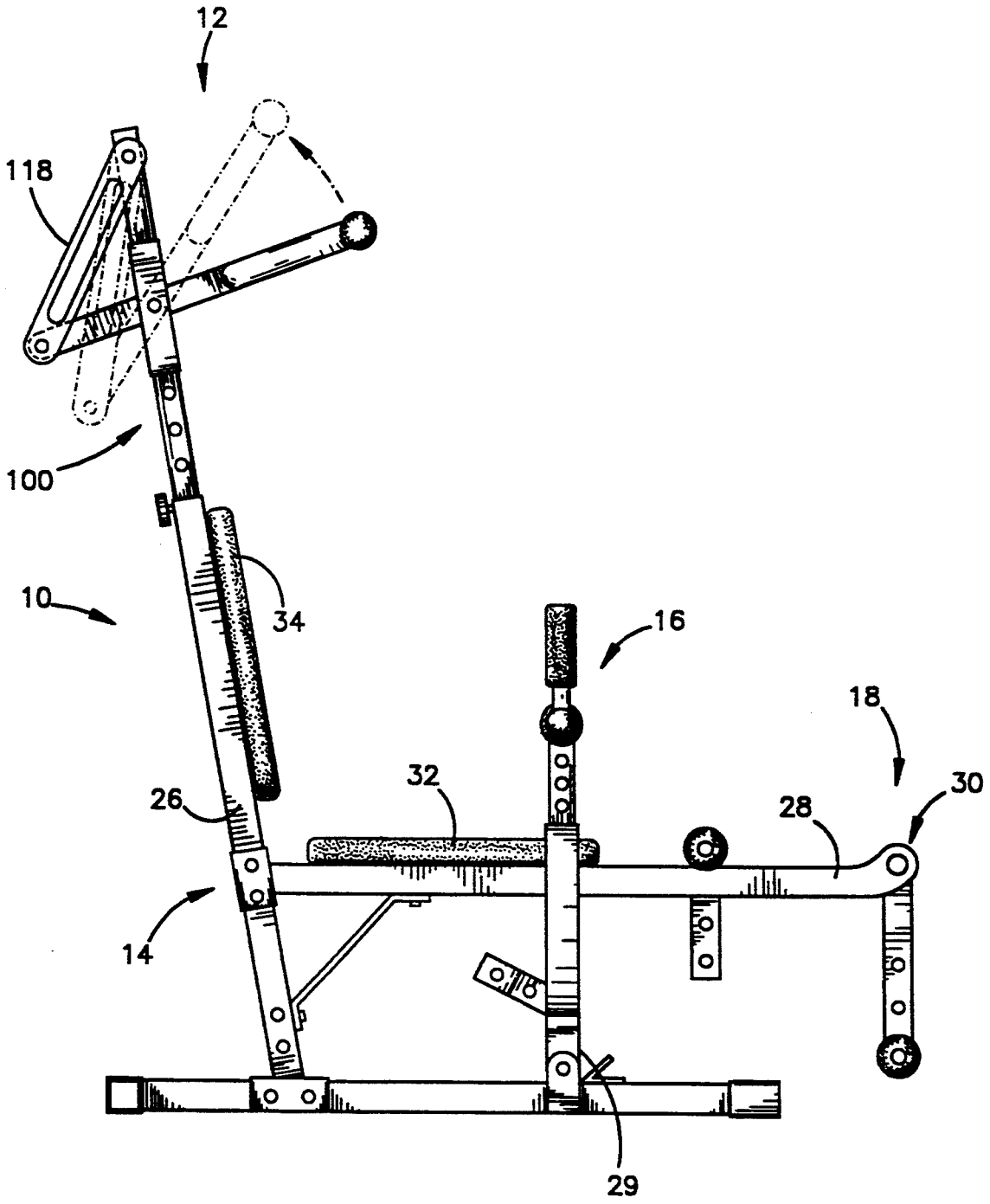
FIG. 3 is a side view of the variable resistance band exercise machine with the arm training components in use.

With the band 118 connected to the upper member 107, as illustrated in FIG. 3, the user can push the handle 116 upward to do a bench press type exercise. Conversely, when band 118 is connected to the lower channel member 106, as illustrated by the solid line band in FIG. 1, the user can pull down on handle 116 against the resistance of band 118 to perform a pull down type exercise.

An important aspect of the present invention is that in either the bench press or pull down type exercises, the user preferably sits on seat 32 with his or her back pressed against back support 34 so as to prevent strain of their back during the exercise. Note that the position of vertical support member 100 can be easily adjusted within frame member 26 to raise or lower handle 116. Also, the resistance exerted by band 118 during the exercise can be increased or decreased by connecting the band 118 to a different adjustment hole in either member 106 or 107 and/or by changing bands to one with greater or lesser wall thickness. Still another feature of the invention is the ability to attach handle component 113 to support member 100 so that the handle 116 is located to the rear of machine 10 above base section 24. In this position, the user is able to perform squat exercises.

Referring now to the waist training component 16, a U-shaped channel member 150, as seen in FIG. 2, has a central section 154 and end sections 154A and 154B. An angled channel member 152 is secured to the center of the central section 154 of the U-shaped member 150. Member 152 has one section which extends downward, below section 154, for pivotal connection to spaced support arms 27 of base member 20. The other end of member 152 extends angularly upward from central section 154 and towards the rear of machine 10 when the U-shaped bar 150 is secured in place. Typically, the two sections of member 152 have an angle of about 30 to about 60 degrees and preferably about 45 degrees to each other. A plurality of spaced, connection holes 160 are provided in the upward section of member 152 to provide a connection point to secure a resistance band 118' with a locking pin. Throughout the specification, primed and double primed numbers represent structural elements which are substantially identical to structural elements represented by the same unprimed number.

The waist training component 16 also includes a pair of adjustably mounted handles 164 and 166 that are constructed of elongated rectangular or square tube members 168 and 170, respectively, each having a plurality of spaced connection holes therethrough. At one end of each of the tube members 168, 170 is a cylindrical tube 172 and 174, respectively, secured thereto and handles 176 and 178 projecting upward from tubes 172 and 174, respectively, in the direction of the axis through the members 168 and 170. The elongated members 168 and 170 are sized to be telescopically received within end sections 154A and 154B, respectively, and secured at a desired position by conventional locking pins.

A unique aspect of the invention is the provision of a horizontal abdominal bar 180 which is mounted through the cylindrical members 172 and 174 and covered with a cylindrical tube 182 of soft material. A lockpin, not shown, is provided through member 172 or 174 to secure the abdominal bar in place.

Figure 4:
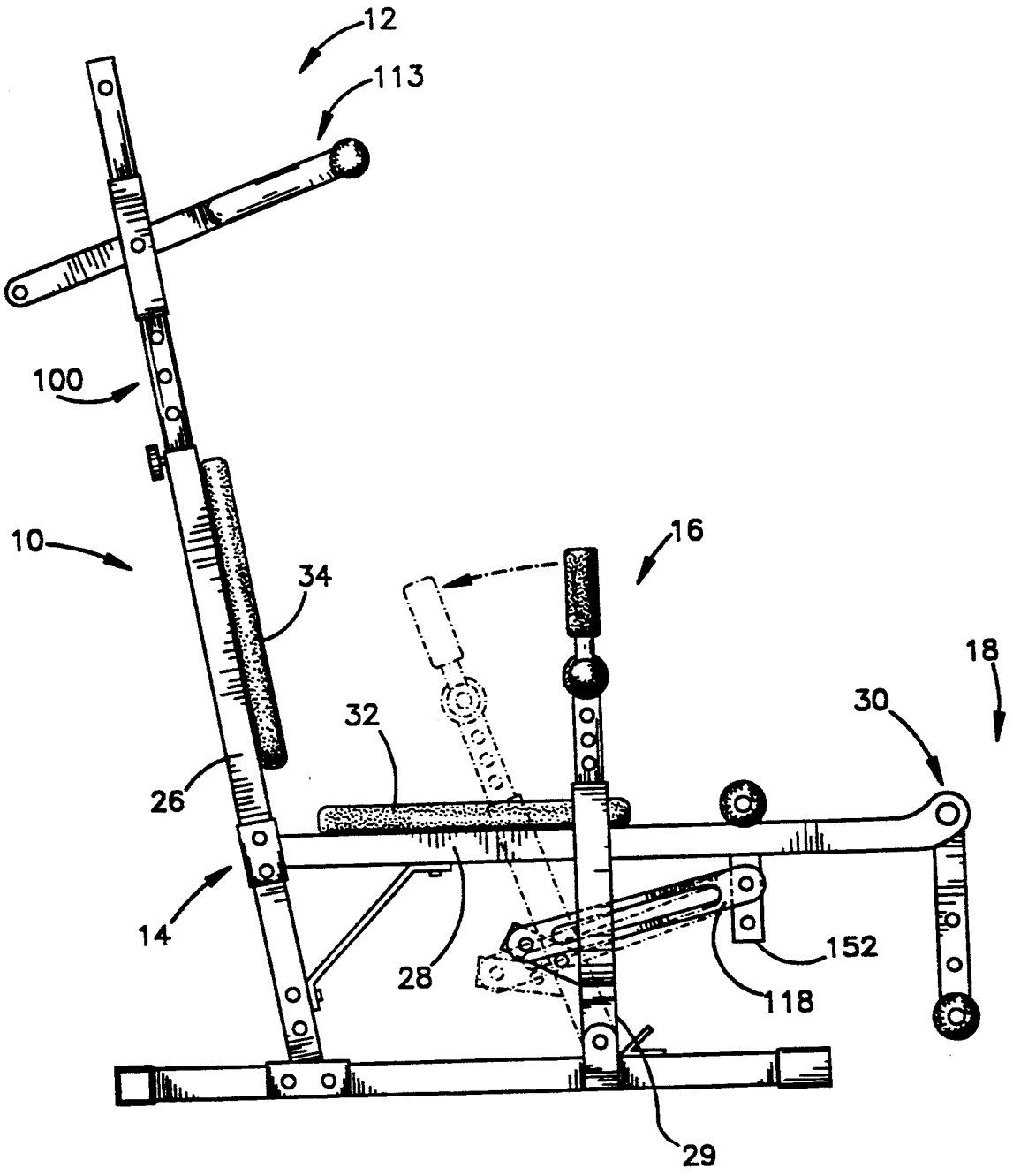
FIG. 4 is a side view of the variable resistance band exercise machine with the waist training components in use.

In operation, a resistance band 118' can be secured with locking pins between a connection hole in member 152 and a connection hole in member 31 extending below frame member 28. With this configuration, as shown in FIG. 4, a user can pull the U-shaped member 150 with handles 176 and 178 rearward to exercise their back and arms. Conversely, when the band 118' is connected between the member 152 and the connection holes at the lower end of frame member 26, as shown in FIG. 1, the user can move the U-bar 150 forward with either their hands or by pressing their stomach against abdominal bar 180. Again, the band 118' can be adjusted or replaced with a band of different wall thickness to change the resistance. Note, that stop member 27, that is mounted on frame member 22, limits the forward movement of the U-frame 150.

Referring now to FIG. 2, there is illustrated the leg training components 18. A rectangular or square tubular member 200 leg support is pivotally mounted at one end to mounting plates 30 at the forward end of frame member 14. The opposite end of member 200 has a perpendicular cross bar 202 extending outward from either end and preferably covered with soft cylindrical tubes which are suitable to be gripped by a user's feet. A plurality of connection holes are provided in member 200 to secure one end of a resistance band 118″ with a locking pin. In operation, the user can sit on seat 32 and press his or her back against back rest 34 while their feet are hooked under the cross bar 202. Then, by straightening their legs, the member 200 pivots upward and outward against the resistance of band 118″ to exercise the user's legs.

Figure 5:
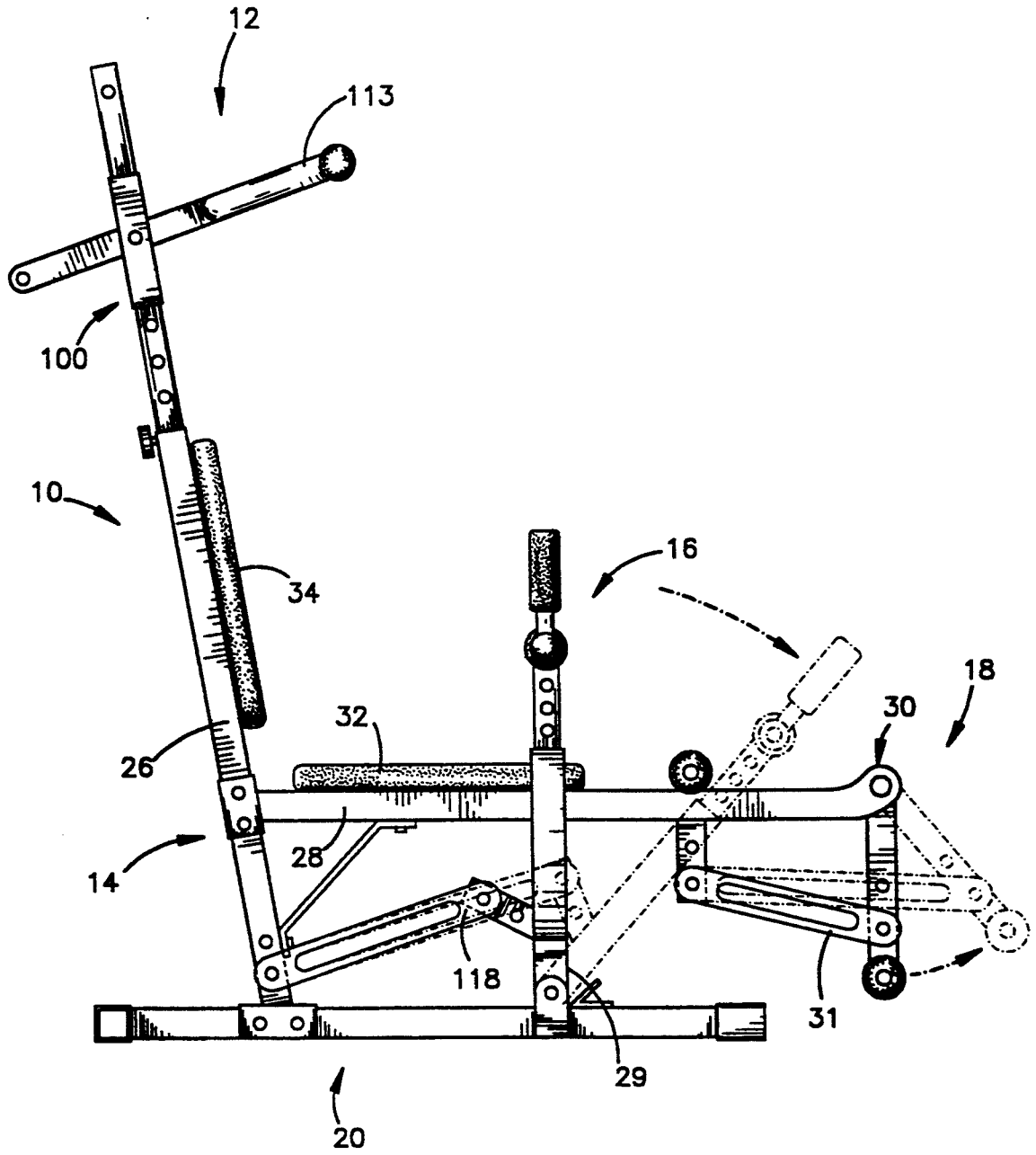
FIG. 5 is a side view of the variable resistance band exercise machine with the leg training components in use.

Another advantage of the present invention is that two exercises can be simultaneously performed. For instance, as illustrated in FIG. 5, a user can do a leg extension while simultaneously moving the U-shaped member 150 forward so as to exercise two sets of muscles at the same time.

While the components of machine 10 are typically constructed of rectangular or square tubular members, it is also within the terms of the invention to use cylindrical tubular members.

It is apparent that there has been provided in accordance with this invention a variable resistance exercise machine which can support the user's back in a variety of exercises and only requires a single resistance band which can be interchanged to work with each of the exercise components.

While the invention has been described in combination with embodiments thereof, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

We claim:

1. A variable resistance band exercise machine, comprising:

a support frame including a base member, an upright back support frame member secured at a lower end to said base member and having a back support, and a seat support frame member secured at a rear end to said upright back support to cantilever outward therefrom above said base member towards the front end of machine, said seat support frame having a seat mounted thereon;

arm training components mounted to the upper end of said upright support frame member, said arm training components including:

a vertical support member adjustably mounted to said upright support frame member and a handle component pivotally attached to said vertical support member; and means for removably connecting a resistance band between said handle component and said upright support frame member to resist the movement of said handle component; and waist training components located forward of said seat on said seat support frame member; said waist training components including:

a U-shaped member pivotally mounted to said base member;

adjustable handles adjustably mounted in said U-shaped member;

a horizontal abdominal bar dismountably connected to said adjustable handles; and means for removably connecting a resistance band between said U-shaped member and said base member to resist the movement of said adjustable handles.

2. The variable resistance band exercise machine of claim 1 further including leg training components, said leg training components including:

a leg support member connected at the forward end of said seat support frame member; and means for removably connecting a resistance band between said leg support member and said seat support frame member to resist the movement of said leg support member.

3. The variable resistance band exercise machine of claim 2 wherein said resistance band has connection holes at either end for removable connection to either said arm training components, said waist training components, or said leg training components.

* * * * *